US006966307B2

(12) United States Patent
Shin

(10) Patent No.: US 6,966,307 B2
(45) Date of Patent: Nov. 22, 2005

(54) FUEL DRAIN STRUCTURE IN FUEL LINE

(75) Inventor: Chang-Hyun Shin, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/749,244

(22) Filed: Dec. 30, 2003

(65) Prior Publication Data

US 2004/0187849 A1 Sep. 30, 2004

(30) Foreign Application Priority Data

Mar. 28, 2003 (KR) ..... 10-2003-0019344

(51) Int. Cl.[7] ..... F02M 37/04
(52) U.S. Cl. ..... 123/514; 123/516
(58) Field of Search ..... 123/514, 456, 123/516, 179.17

(56) References Cited

U.S. PATENT DOCUMENTS 5,074,272 A * 12/1991 Bostick et al. ..... 123/514
5,199,402 A * 4/1993 Melchior ..... 123/447
5,327,872 A * 7/1994 Morikawa ..... 123/516
5,626,121 A * 5/1997 Kushida et al. ..... 123/514
5,918,578 A * 7/1999 Oda ..... 123/456
6,024,064 A * 2/2000 Kato et al. ..... 123/179.17
6,647,957 B1 * 11/2003 Cha ..... 123/359
6,647,968 B1 * 11/2003 Hankins et al. ..... 123/514
6,691,683 B2 * 2/2004 Gracyalny et al. ..... 123/516

FOREIGN PATENT DOCUMENTS

JP 60-222550 11/1985

* cited by examiner

*Primary Examiner*—Carl S. Miller
(74) *Attorney, Agent, or Firm*—Morgan Lewis & Bockius LLP

(57) ABSTRACT

A fuel drain structure in a fuel line comprising a bypass channel for connecting a fuel influx side and a fuel efflux side of a regulator, and a rotary valve for opening and closing the bypass channel, contributing to a prevention of fuel remaining in the fuel line from entering the engine when the engine stops running, and minimization of pollution occurring when the engine is re-started.

1 Claim, 4 Drawing Sheets

FUEL DRAIN STRUCTURE IN FUEL LINE

CROSS-REFERENCE TO RELATED APPLICATIONS

This application claims priority of Korean Application No. 10-2003-0019344, filed on Mar. 28, 2003.

FIELD OF THE INVENTION

The present invention relates to a fuel drain structure in a fuel line, and more particularly to a drain structure for draining fuel from the line when the engine stops running.

BACKGROUND OF THE INVENTION

In general, when an engine stops running and fuel provided from a fuel pump remains in a fuel line, the fuel tends to flow into the engine via an injector due to pressure increased by high temperature around the engine, which contributes to air pollution by excessive incomplete combustion when the engine gets re-started.

SUMMARY OF THE INVENTION

Embodiments of the present invention provide a fuel drain structure in a fuel line for effectively draining the fuel leftover in the fuel line when the engine ceases moving, thereby preventing the fuel from leaking into a combustion chamber via an injector and thus reducing incomplete combustion of the fuel when the engine is re-started.

In one embodiment of the present invention, a fuel drain structure in a fuel line comprises a regulator adjusting pressure of fuel pumped out from a fuel pump to a fuel line, wherein the regulator includes a housing forming a chamber by coupling with a valve seat. A fuel inlet is at one side of the chamber while a fuel outlet is formed at the valve seat. A valve is resiliently supported via a spring at an upper side of the valve seat. A bypass channel connects a fuel influx passage and a fuel efflux passage of the regulator, such that the fuel leftover inside the fuel line is forced to flow into the fuel tank through the bypass channel while the engine stops running.

BRIEF DESCRIPTION OF THE DRAWINGS

For a better understanding of the nature and objects of the present invention, reference should be made to the following detailed description with the accompanying drawings, in which:

FIGS. 3 and 4 illustrate operational states of the regulator according to an embodiments of the present invention, wherein FIG. 3 shows a state when an engine is running and FIG. 4 illustrates a state when the engine stops running.

DETAILED DESCRIPTION OF THE PREFERRED EMBODIMENTS

A preferred embodiment of the present invention will now be described in detail with reference to the accompanying drawings.

Figure 1:
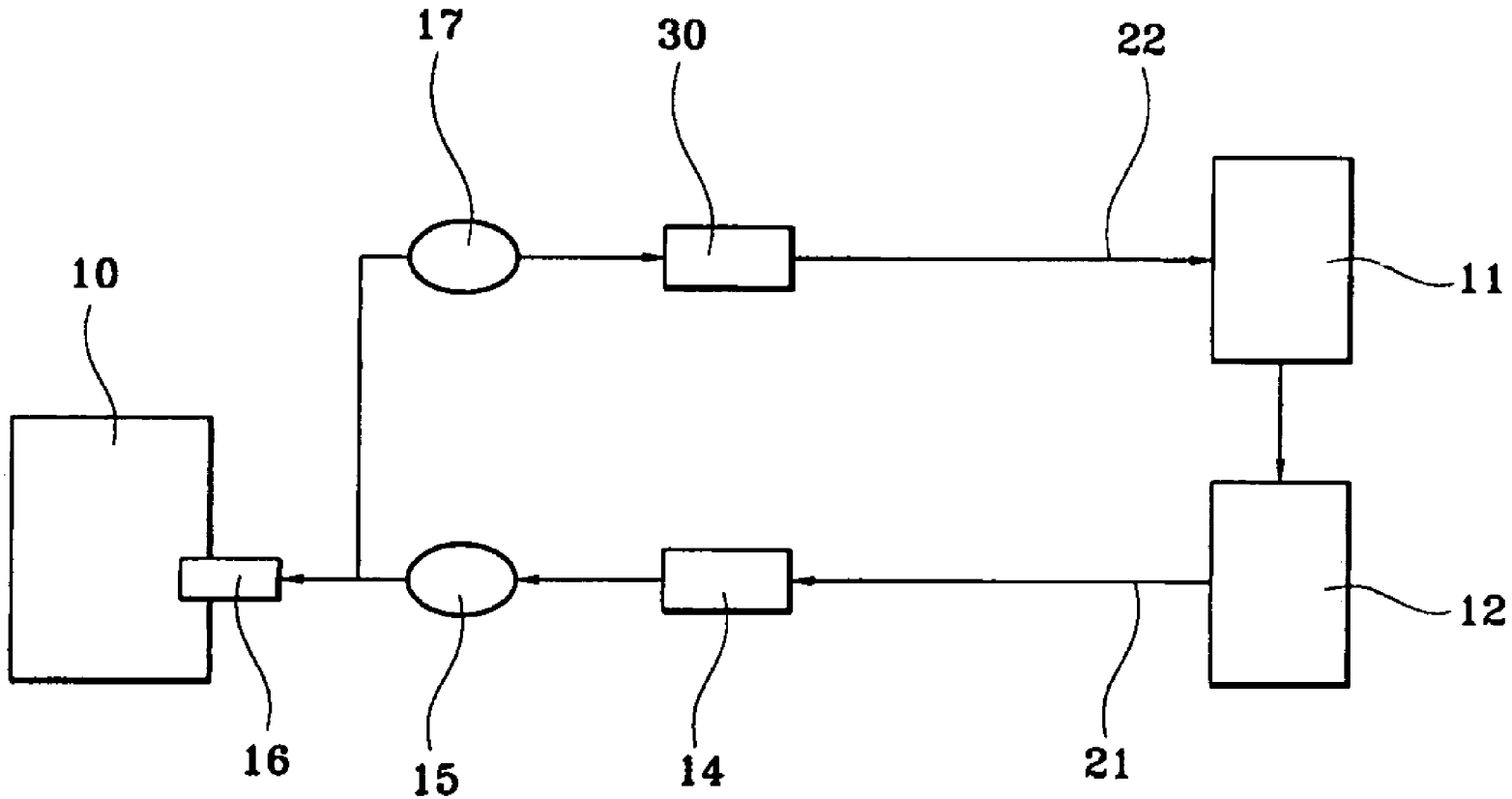
FIG. 1 is a block diagram of a fuel supply system including a regulator according to an embodiment of the present invention.

As shown in FIG. 1, fuel pumped out from a fuel tank 11 via a fuel pump 12 is filtered at a fuel filter and is injected into an intake manifold of an engine 10 through an injector 16. A pressure sensor 17 and a regulator 30 are mounted at a return line 22 for adjusting the fuel pumped from the fuel pump 12 to be injected through the injector 16 to the engine at a constant pressure. A fuel-stopping solenoid valve 14 restricts the fuel from being provided to the injector 16 according to the on/off state of the ignition key, and a temperature sensor 15 measures fuel temperature. Both the fuel-stopping solenoid valve 14 and temperature sensor 15 are mounted at a feed line 21.

Figure 2:
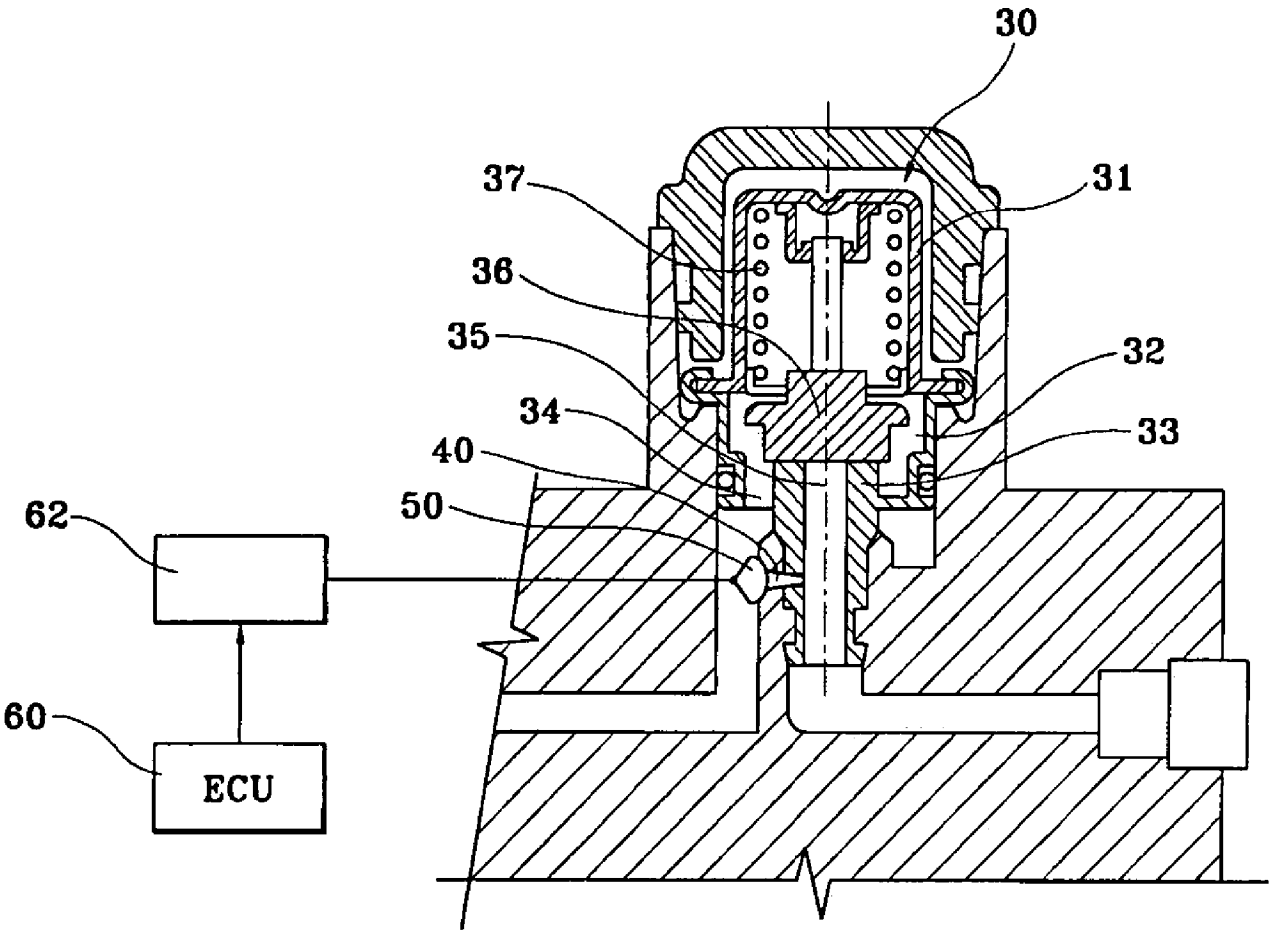
FIG. 2 is a schematic view of a regulator according to an embodiment of the present invention.
Figure 3:
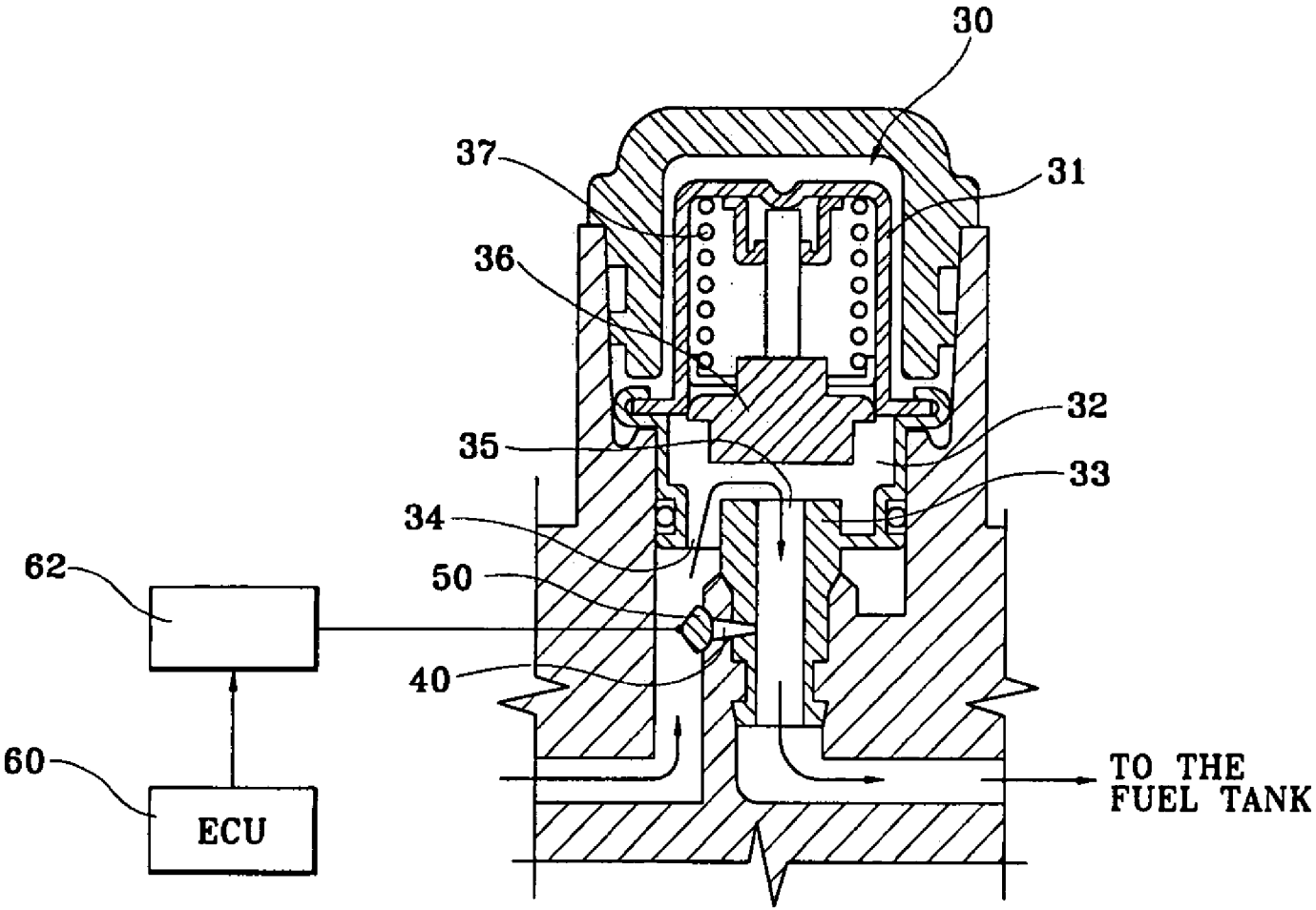
Figure 4:
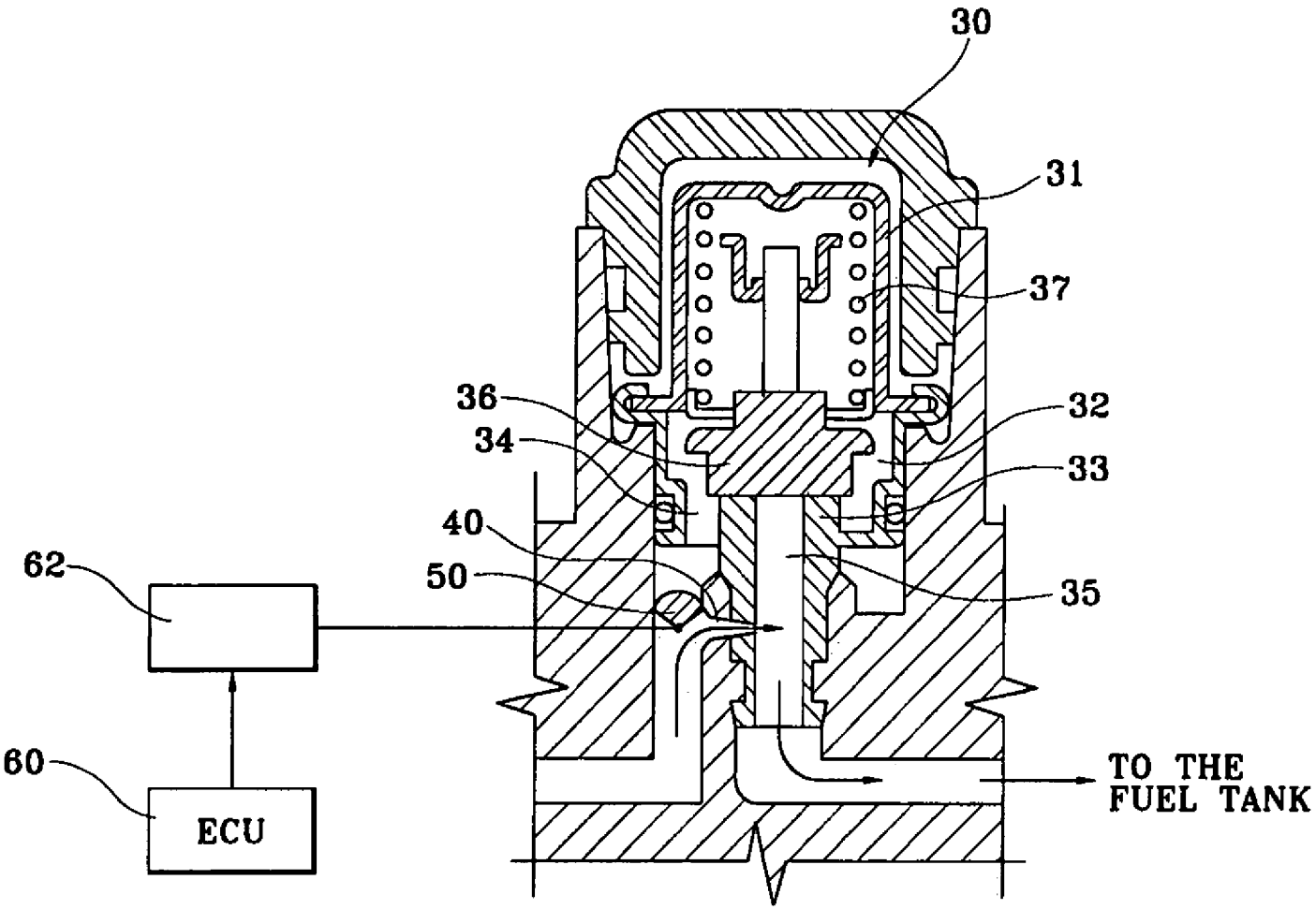

With reference to FIG. 2, the regulator 30 comprises a housing 31 forming a chamber 32 by coupling with a valve seat 33. A fuel inlet 34 is at one side of the chamber 32 for allowing the fuel to flow therein from the return line 22. A fuel outlet 35 is formed at the valve seat 33 for guiding the fuel passed through a valve 36 to flow back to the return line 22.

The valve 36 resiliently supported by a spring 37 is secured at an upper side of the valve seat 33. When pressure of the fuel applied to the fuel inlet 34 is higher than the resilient force of the spring 37, the valve 36 ascends, and the fuel starts to pass through the fuel outlet 35.

A bypass channel 40 traverses the influx and efflux passages of the regulator 30. The bypass channel 40 may be an independent pipe or integrally formed with the housing 31. By way of reference, the bypass channel is preferably about b 0.3 mm in diameter.

The cross-sectional view of the inlet side of the bypass channel 40 is funnel-shaped, and the inlet of the bypass channel 40 has a larger diameter than the outlet. A rotary valve 50 having a sectoral-spool shape in its cross-sectional view is mounted at the inlet side of the bypass channel 40. The rotary valve 50 operates in response to an actuator 62 activated by an electronic control unit (ECU) 60. The ECU may comprise a processor and other associated hardware and software or firmware as may be selected and programmed by a person of ordinary skill in the art based on the teachings set forth herein.

The rotary valve 50 is activated by the actuator 62 in the embodiment of the present invention, however, the operational means may be an actuator, a rotational force of a motor or the like. The ECU 60 renders the rotary valve 50 to be closed when the engine is started, and be opened when the engine is stopped in motion.

The operation of the present invention will now be described.

Once the engine starts to move, the fuel pumped out from the fuel pump is delivered into the feed line 21 through the opened fuel-stopping solenoid valve 14, and is injected via the injector 16 into the engine at a preset pressure. Fuel not injected through the injector returns to the fuel tank 11.

When the engine stops its motion, some of the fuel still remains in the fuel line without being injected through the injector 16.

The ECU 60, therefore, detects whether the engine ceases running, and if so, stops the activation of the fuel pump 12, and closes the fuel-stopping solenoid valve 14. The ECU 60 further rotates the rotary valve 50 to an open side for leading the fuel rested between the fuel-stopping solenoid valve 14 and the regulator 30 of the fuel line to be discharged through the bypass channel 40.

The fuel remaining in the fuel line returns to the fuel tank 11 through the bypass channel 40, such that the fuel is not injected into the engine 10 via the injector 16 due to the temperature and pressure being increased by heat around the engine.

As apparent from the foregoing, there is an advantage in the fuel drain structure in a fuel line in that the fuel inlet side and fuel outlet side of the regulator is connected by the bypass channel being opened and closed via the rotary valve, resulting to prevent the fuel remaining in the fuel line from entering the engine through the injector when the engine stops its operation, thus reducing pollution in the course of re-starting the engine.

What is claimed is:

1. A fuel drain structure in a fuel line comprising:

a regulator adjusting pressure of fuel pumped out from a fuel pump to a fuel line, including: a housing forming a chamber by coupling with a valve seat, a fuel inlet formed at one side of said chamber, a fuel outlet formed at said valve seat, a valve resiliently supported via a spring at an upper side of said valve seat;

a bypass channel directly connecting said fuel inlet and said fuel outlet of said regulator, such that the residual fuel inside said fuel line is forced to flow into a fuel tank through said bypass channel while the engine stops running, wherein said bypass channel is in a funnel shape; and a rotary valve having a sectoral-spool shape is further disposed at an inlet side of said bypass channel, wherein said rotary valve is activated by an actuator operated in response to an electronic control unit (ECU).

* * * * *